United States Patent [19]

Connelly

[11] Patent Number: 4,901,971

[45] Date of Patent: Feb. 20, 1990

[54] CHRISTMAS TREE STAND

[76] Inventor: Richard E. Connelly, 15 Township Rd. 1400, Jeromesville, Ohio 44840

[21] Appl. No.: 307,064

[22] Filed: Feb. 6, 1989

Related U.S. Application Data

[63] Continuation-in-part of Ser. No. 157,601, Feb. 19, 1988, abandoned.

[51] Int. Cl.[4] ..... A47G 7/02

[52] U.S. Cl. ..... 248/523; 248/188.2; 248/151; 248/225.1; 47/40.5

[58] Field of Search ..... 248/523, 524, 525, 526, 248/527, 514, 188.2, 225.1, 316.2, 231.3, 151, 146, 148, 359 F, 359 H; 47/40.5

[56] References Cited

U.S. PATENT DOCUMENTS

| | | | |
|---|---|---|---|
| 1,255,557 | 2/1918 | Norman . | |
| 1,540,856 | 6/1925 | Munro | 248/523 |
| 1,855,762 | 4/1932 | Kaminski . | |
| 1,997,870 | 4/1935 | Merrill | 248/524 |
| 2,454,231 | 11/1948 | Stoick . | |
| 2,630,286 | 3/1953 | Dieckhoff . | |
| 2,639,877 | 5/1953 | Fox . | |
| 2,686,642 | 8/1954 | Dobarganes et al. | 248/523 |
| 3,038,689 | 6/1962 | Matson . | |
| 3,350,043 | 10/1967 | Apple | 47/40.5 |
| 3,403,877 | 10/1968 | Gudmundson . | |
| 3,469,342 | 9/1969 | Morris . | |
| 3,779,493 | 12/1973 | Gidlof | 248/523 X |
| 4,436,272 | 3/1984 | Lile et al. | 248/527 |
| 4,693,381 | 9/1987 | Lodge | 248/225.1 X |

FOREIGN PATENT DOCUMENTS

| | | | |
|---|---|---|---|
| 3512566 | 10/1986 | Fed. Rep. of Germany | 248/523 |
| 1368047 | 6/1964 | France | 248/523 |

*Primary Examiner*—Ramon S. Britts
*Assistant Examiner*—Karen J. Chotkowski
*Attorney, Agent, or Firm*—D. Peter Hochberg; Mark Kusner; Louis J. Weisz

[57] ABSTRACT

A Christmas tree stand includes a flat-bottomed, water-tight canister supported by adjustable legs mounted thereon, the adjustability feature accommodating uneven surfaces and crooked tree trunks. The interior of the canister has a transverse pentagonal shape, open at the top and bounded by side walls, a rear wall and a pair of convergent front walls, the latter forming an angled juncture. A screw crank extends through the rear wall transversely centered in, and above the middle thereof, opposite said juncture. The screw crank urges a rectangular free-floating push plate positioned in the canister's interior against the trunk of a Christmas tree positioned in the interior between the junction and the push plate. Rotation of the screw crank advances the screw end of the crank, applying pressure against the push plate, and through the latter against the tree, thereby positioning and securing the tree in the stand.

14 Claims, 6 Drawing Sheets

CHRISTMAS TREE STAND

This application is a continuation-in-part application of Application Ser. No. 157,601, filed Feb. 19, 1988 and now abandoned.

TECHNICAL FIELD

This invention relates to stands for holding elongated objects. More particularly, this invention relates to stands for holding Christmas trees in an upright position. Specifically, this invention relates to a Christmas tree stand in which the trunk of the tree is placed within a pentagonally shaped tubular cavity and urged by a screw driven plate against a corner of the cavity, forcing the tree into a generally vertical position.

BACKGROUND OF THE INVENTION

Christmas trees have become an almost universal symbol for Christmas, and each year uncounted millions of such trees are placed in homes and decorated with ornaments. To be useful for the purpose described, the trees must be supported in a vertical position by a stand of some sort, and it is highly desirable that provision be made for supplying the trees with water to prevent needle drop and the fire hazard attendant to a dried-out tree.

Many types of stands for Christmas trees have been suggested in the past; however, many of these have limitations which make them difficult to use, or unsuitable for a variety of reasons. A deficiency common to many types of Christmas tree stands, for example, is that they are usually limited in the range of trunk sizes which they can accommodate. A person using such a stand must either select a tree with a trunk having an appropriate diameter, or the trunk must be trimmed or shimmed to a size within a range appropriate for the stand. U.S. Pat. Nos. 1,855,762; 2,639,877; and 3,403,877 are examples of such stands.

Another common problem encountered with Christmas tree stands is that many are difficult to use. Frequently, the stands require the cooperation of two individuals to fasten the tree in the stand, for example, one to hold the tree in position, while the other tightens fasteners which mount the tree in the stand. Examples of such stands are those described in the above patents, as well as in U.S. Pat. Nos. 2,454,231; 2,630,286; 1,540,856; 1,255,557; and 3,038,689. Stands employing such fasteners also suffer from the fact that the fasteners partially penetrate the trunk against which they are forced, making removal of the tree difficult when it is to be discarded.

Still other stands are unstable and unable to resist the weight of ornaments placed on them, as well as the minor forces that are sometimes inadvertently applied to the tree by children, household pets and the like.

Still other Christmas tree stands are unsatisfactory for the reason that they are unable to function unless the tree is inserted into the stand in a vertically oriented position, or work poorly in instances where the trunks of the trees are somewhat crooked or gnarled.

Some of the stands previously proposed are also difficult to clean, resulting in a build up of tree resin and other debris when the tree, and water held by the stand are removed. The problem is particularly acute in the case of stands having relatively inaccessible surfaces.

BRIEF DISCLOSURE OF THE INVENTION

In view of the proceeding, therefore, it is a first aspect of the instant invention to provide a Christmas tree stand capable of accepting a wide range of trunk diameters.

It is a second aspect of the invention to provide a Christmas tree stand that enables a single individual to set and secure a tree within the stand.

It is another aspect of the invention to furnish a Christmas tree stand that facilitates the easy removal of the tree when it is being dismantled.

An additional aspect of this invention is to furnish a Christmas tree stand that automatically adjusts to accommodate and hold Christmas trees with gnarled and twisted trunks in an upright position.

A still additional aspect of this invention is to make available a Christmas tree stand that is highly stable, and one that is not readily tipped due to the inadvertent application of minor forces thereon.

Another aspect of this invention is to provide a Christmas tree stand that forces trees inserted in the stand into an upright position, almost regardless of the position in which the tree is inserted into the stand.

A still further aspect of the invention is to provide a Christmas tree stand that can be adjusted to accommodate bent tree trunks or uneven floors.

it is a further aspect of the present invention to provide a Christmas tree stand that allows the tree to draw water from the stand into its foliage, preventing the tree from drying out.

It is another aspect of the present invention to provide a Christmas tree stand that is readily cleaned after removal of the tree from the stand.

The foregoing and other aspects of the invention are provided by a stand for holding a Christmas tree comprising components which include:

an elongate cannister;
a free-floating push plate;
push plate adjusting means; and
two support legs, wherein said cannister has interconnected panels comprising: a rear wall, two parallel side walls, two converging walls, and a bottom in sealing relationship with the lower end of said walls, said walls defining a tube whose interior is adapted to receive the lower trunk of said tree, and wherein said push plate is not fastened to the other components of said stand and is dimensioned to be received and moved within said tube, parallel to said side walls, and wherein further, said push plate adjusting means is mounted on said rear wall and adapted to adjust the position of said plate relative to the corner formed by the juncture of said converging walls, said adjusting means being operable to move said plate toward said corner to force said trunk into said juncture, and wherein still further, said support legs are adapted for being fastened adjacent to the lower end of said cannister so as to enable it to be supported in a generally vertical position.

The preceding and additional aspects of the invention are provided by a Christmas tree stand comprising:

an elongate cannister;
a free-floating push plate;
push plate adjusting means; and
two support legs, wherein said cannister has interconnected panels comprising a rear wall, two parallel side walls, two converging walls, and a bottom in sealing relationship with the lower end of said walls, said interconnected walls defining a tube having a generally pentagonal transverse cross-section, the interior of said tube being adapted to receive the lower trunk of said tree, and wherein said push plate is dimensioned to be received and moved within said tube, parallel to said side walls, and wherein further, said adjusting means comprises a crank having a threaded end, said threaded end extending in threaded engagement through said rear wall into the interior of said cannister, against said push plate, said crank being operable to move said plate against said trunk, thereby moving said trunk toward the corner formed by the juncture of said converging walls, and wherein still further, said support legs are elongate members connected to said cannister at an angle by anchoring structure so as to enable said cannister to be supported in a generally vertical position, the connection being adjustable so that said angle can be varied to conform the disposition of said legs to a surface on which said stand rests, and to compensate for crooked tree trunks, said anchoring structure comprising two vertical slotted tracks located on the exterior of each of said side walls, the tracks on each of said side walls being connected to one of said legs by fasteners, one end of which is adapted to be retained by, and moved within said tracks, while the other end of said fasteners is adapted to be inserted through a hole passing through said leg and to be retainably secured in that position.

BRIEF DESCRIPTION OF THE DRAWINGS

The invention will be better understood when reference is had to the following Figures, in which like-numbers refer to like-parts, and in which.

DETAILED DESCRIPTION OF THE INVENTION

Figure 1:
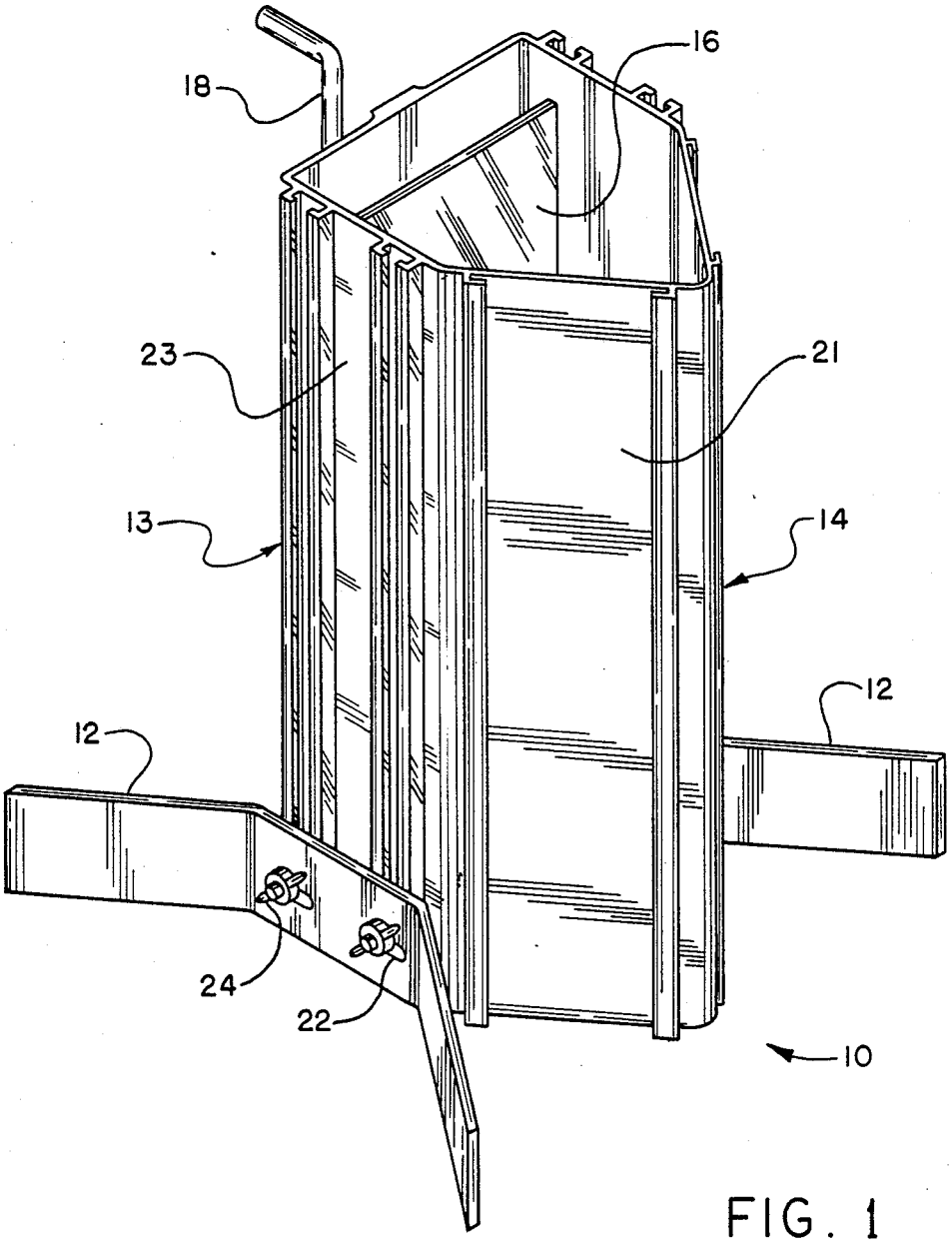
FIG. 1 is an isometric view of the Christmas tree stand of the preferred embodiment of the invention.

FIG. 1 is an isometric view of the Christmas tree stand of the preferred embodiment of the invention, generally 10. The Figure shows the receptacle canister 14, connected to support legs 12 by threaded fasteners, generally 24, inserted through fastener receiving slots 22. The canister comprises a tube member with a rear wall 20, side walls 23, and convergent front walls 21, to which a bottom is fastened, the latter being better seen in FIG. 3. A "free-floating", i.e. unattached to the other components of the stand, push plate 16 is urged by a threaded screw crank 18 toward the angle formed between the convergent walls.

To use the Christmas tree stand, the screw crank is retracted towards the rear wall 20 and the push plate 16 is loosely inserted into the cannister. Thereafter, the trunk of the Christmas tree is placed between the push plate and the end of the tree stand defined by the converging walls. The screw crank is thereupon rotated to advance the push plate against the tree trunk, forcing the trunk forward where it eventually becomes tightly wedged in an upright position against the angle formed by the convergent walls. Due to the floating action of the push plate, the tree is simultaneously forced upright and centered, even where the trunk of the tree is gnarled or twisted, enabling the tree to be rapidly installed by a single individual, one of the notable advantages of the stand. Such result is due to the fact that the unattached plate is free to "rise" over and around trunk irregularities.

Once the tree had been erected as described, water or other liquid can be added to the interior of the canister to keep the tree from drying out prematurely.

While the stand is particularly designed for use with Christmas trees, it can also be employed to support other types of trees, as well as any of various elongated objects, such as flag poles, signs, vertical supports, and the like. Furthermore, although the stand has been described in connection with holding objects vertically upright, the stand can also be used to support objects extending in other directions as well.

Figure 2:
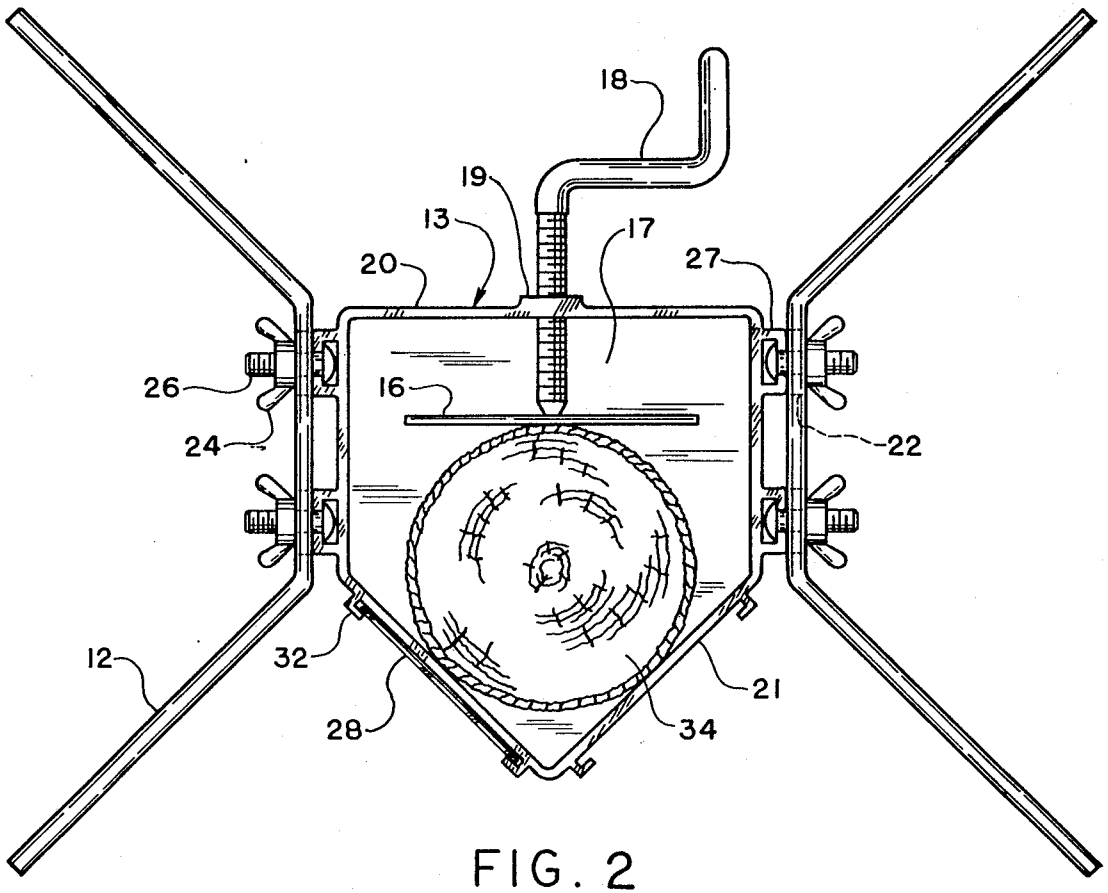
FIG. 2 is a plan view of the Christmas tree stand of FIG. 1 showing the trunk of a Christmas tree positioned in the stand.

FIG. 2 is a plan view of the Christmas tree stand shown in FIG. 1 showing the trunk of a Christmas tree positioned in the stand.

As illustrated, the canister, including tube 13 with the bottom panel 17 sealably secured to the lower end thereof, is fastened to support legs 12 by means of threaded fasteners. As shown, the threaded fasteners comprise bolts 26, the head-end of which is disposed and retained within slotted tracks 27. The opposite, threaded ends of the bolts pass through fastener receiving slots 22, where they are secured by wing nuts 24. A screw crank 18 is shown threaded through rear wall 20, its threaded end bearing against the free-floating push plate 16. The free-floating push plate in turn bears against the lower end of a tree trunk 34, forcing it into the angle formed by the convergent front walls 21. In a preferred embodiment of the invention, front walls 21 are provided with retaining grooves 32 into which a placard 28 may be inserted. The use of placards is of advantage, for example, in connection with advertising matter, decorative designs and patterns, and for related uses. The shape of the support legs of the Figure are bent outward at an angle sufficient to provide stability to the tree-containing stand. While the ends of the legs illustrated in the Figure extend outwardly from the middle portion of the legs at an angle of about 45 degrees, the magnitude of the angle is relatively unimportant, it simply being necessary to assure that the angle is sufficient to provide stability to the tree-containing stand. Other leg configurations can also be used, however, for example, support legs having a somewhat outwardly curved, concave configuration, when viewed from the top.

While different types of fasteners may be used to secure the support legs 12 to the tube 13 of the cannister, the use of threaded fasteners, such as, for example, stove bolts, carriage bolts, machine screws, cap screws or other fasteners, employed in association with any of various nuts, including, particularly wing nuts and the like, is preferred.

Considerable latitude may be exercised in the dimensions suitable for the stand of the invention, and will depend upon the nature of the object being supported.

In the case of a Christmas tree stand, however, it has been found convenient to employ a stand with side walls about three to four inches wide, a rear wall about four to six inches wide, and converging walls about three to four inches wide. Likewise, the angle formed by the converging walls may be varied, and will depend somewhat on the shape and size of the object being supported. An angle of from about 60 to 100 degrees is suitable for most purposes, with an angle of about 90 degrees being preferred.

The end portions of the support legs will typically be about 7 to 12 inches long, while the middle portion will be from about 4 to 6 inches long, and when the support leg is in the form of a vertical flange-shaped member, it will be from about 2 to 4 inches high. The length of the crank screw will depend upon the other dimensions of the stand; however, in the case of a stand having the dimensions described, the use of a crank with a threaded portion about 3 to 5 inches long is preferred.

The use of horizontal elongated slots 22 in connection with the fasteners 26 is desirable since they allow the support legs to be adjusted over a wider range of angles, relative to the horizontal, as is described in more detail in connection with FIG. 5; however, other shaped holes, including round holes may also be used.

Figure 3:
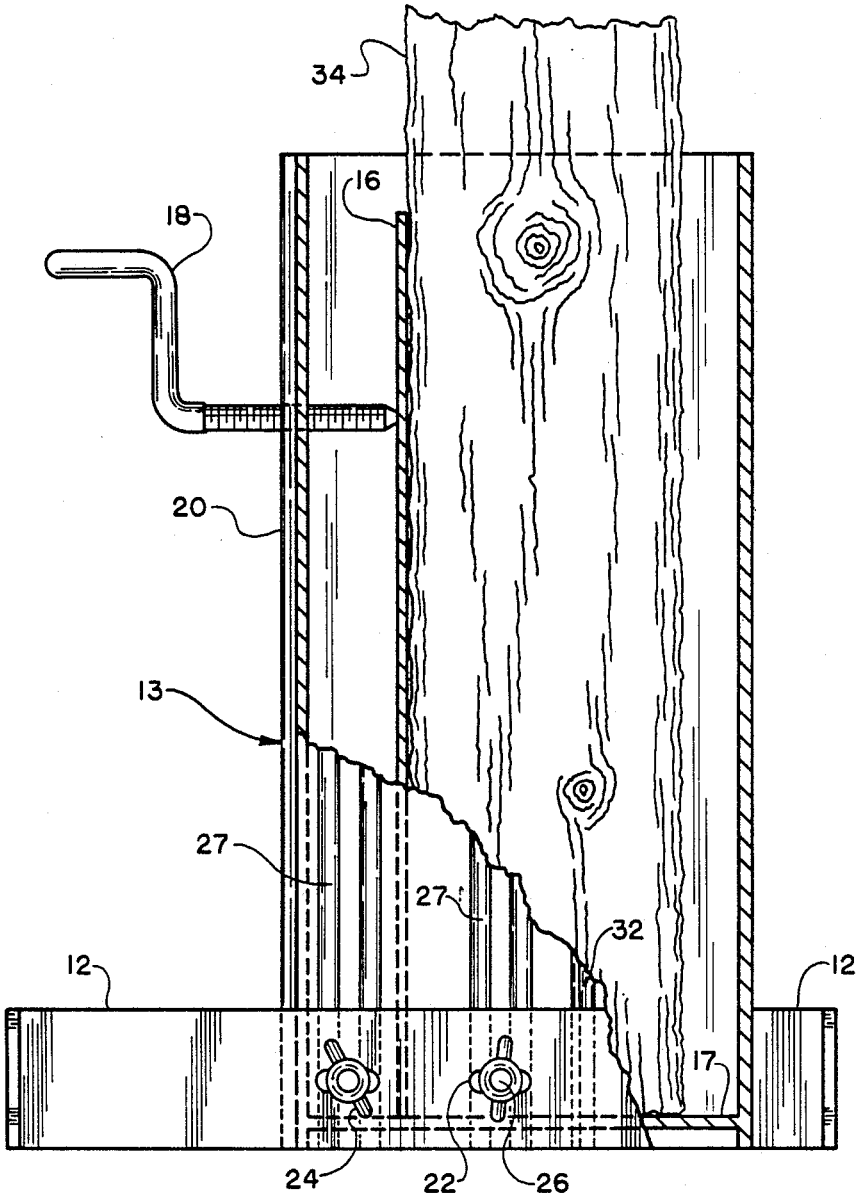
FIG. 3 is a partially sectioned right-side view of the Christmas tree stand illustrated in FIG. 1.

FIG. 3 is a partially sectioned right-side view of the Christmas tree stand illustrated in FIG. 1. The Figure amplifies the description of the way in which screw crank 18 extends through rear wall 20, urging push plate 16 against the tree trunk 34. Also shown is bottom panel 17 which seals the lower end of the tube 13, forming the canister. As can be seen in the Figure, a threaded fastener 26, whose head is retained in slotted track 27, extends through the fastener receiving slot 22 in support leg 12, being held in that position by wing nut 24. The placard-holding retaining grooves 32 are also illustrated.

In the case of a Christmas tree holder having dimensions approximately as described previously, the height of the tube 13 will normally be between about 10 to 15 inches high, although other heights may be employed, depending upon factors such as the size of the objects to be supported, the amount of water to be contained in the canister, and related matters. The Figure illustrates a screw crank 18, passing through the transverse center of, and threadably engaged with rear wall 20. Since the water level is normally kept below the screw crank to avoid leakage, the vertical location of the crank will depend upon the amount of water to be stored, the height of the tube, and similar considerations. If desired, the tube 13 may be provided with a bushing, for example, made from plastic, through which the screw crank is threaded, to reduce leakage past the threads, or other seals of the types well known in the art may be employed.

The dimensions of the free-floating push plate 16 will depend upon those of the tube 13; however, with a stand having the dimensions described, the push plate will normally be from 9 to 10 inches high and 4 to 6 inches wide, the widths being adjusted so that the plate can be readily moved between the side walls of the tube, responsive to the urging of screw crank 18.

Figure 4:
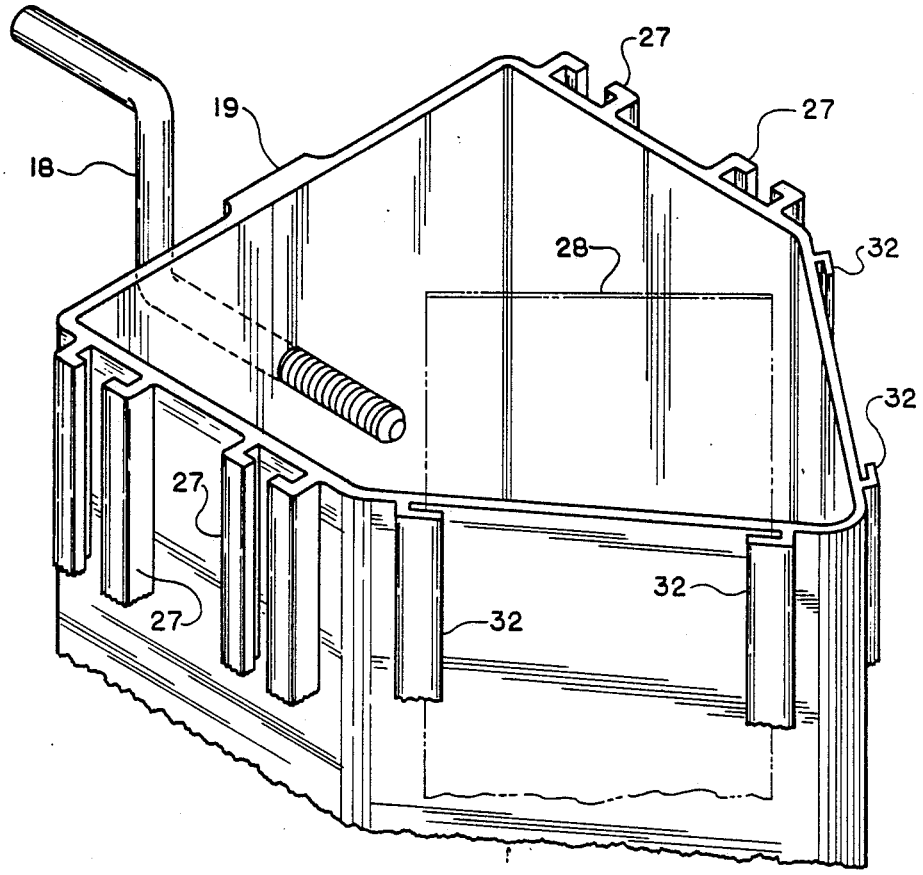
FIG. 4 is a partial isometric view showing the top of the Christmas tree stand of FIG. 1.

FIG. 4 is a partial isometric view showing the top of the Christmas tree stand of FIG. 1. The Figure illustrates in greater detail the slotted track 27, and the retaining grooves 32, between which latter a placard, shown in phantom 28, can be inserted. Also shown is the screw crank 18 extending through the rear wall of the tube, preferably through a thickened crank rib 19, which facilitates threadable engagement of the screw crank with the rear wall, and reinforces the structure.

The dimensions of the slotted track 27 will depend upon the nature of the fastener used to attach the support legs; however, again, in connection with the dimensions mentioned, the inside of the track will be from about one-half to about one inch wide and about one-quarter inch deep, and will be provided with an opening slot approximately one-quarter inch wide. Similarly, and again with reference to the dimensions described, the retaining grooves will commonly be L-shaped projections with outer walls about one-eighth inch wide, defining a groove opening of about one-sixteenth inch deep.

The tube can be fabricated in any of a variety of ways, for example, by forming the walls separately, and thereafter joining them in various ways well known to the art. Preferably, however, the tube will be extruded through a die, since such method of fabrication is both simple and inexpensive. The exterior of the tube may either be smooth or embellished with suitable decorations, such as ribbing, dimpling, stippling, or other features.

Figure 5:
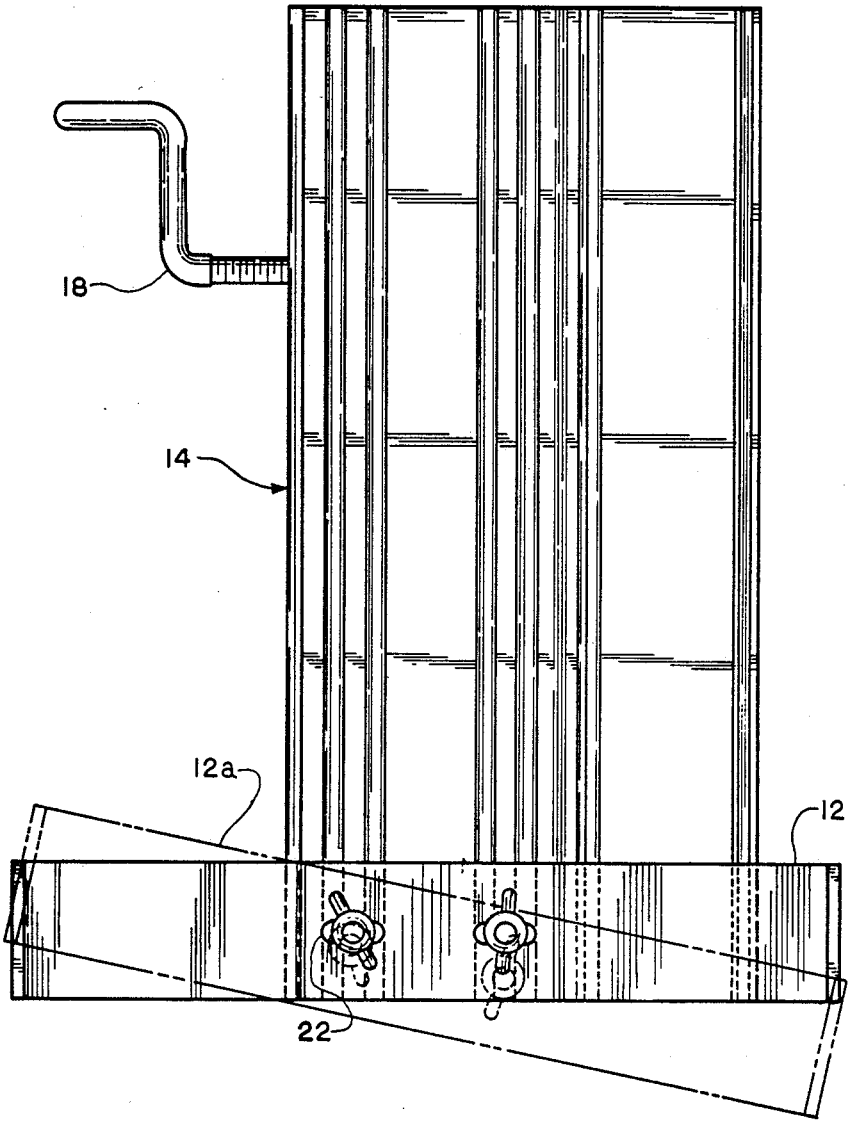
FIG. 5 is a side elevation of the Christmas tree stand of the invention showing varying positioning of the support legs.

FIG. 5 is a side elevation of the Christmas tree stand of the invention showing varying positioning of the support legs.

The Figure illustrates how the support legs may be adjusted to compensate for crooked tree trunks or for variations in the surface on which the support legs rest. When the stand is positioned on a level surface, the fasteners extending from the slotted tracks on the canister through the fastener receiving slots 22 in the support legs 12 are positioned at the same level, disposing the support legs at right angles to the vertical canister tube. When, however, the surface is uneven, the fasteners can be placed at whatever level in the slotted track, and whatever position in the fastener receiving slots is required to adjust the support legs at an angle which maintains the tube in a vertical position, while allowing the legs to maintain contact with the uneven surface. The adjustment feature also allows the stand itself to be tilted to compensate for badly bent tree trunks so that the top portion of the tree remains generally vertical in spite of a bent lower trunk. The two support legs can be adjusted to the same angle, or to different angles, as required by the surface. The Figure illustrates positioning at a tilted angle by the phantom support legs 12*a*.

The canister, support legs, and free-floating push plate may be formed from any suitable material, for example, metal or plastic or a combination thereof. The use of metal, particularly in the case of the free-floating push plate is preferred, however, and the use of a sturdy, light-weight material such as aluminum is particularly preferred. When aluminum is employed, and the bottom panel 17 is attached to tube 13 by aluminum welding, it is desirable that the surface of the weld be sealed with a suitable coating, for example, with a sealing resin, preferably containing finely divided metal particles as a filler. The purpose of the coating is to seal any holes which may have developed in the region of the weld during the welding process.

Figure 6:
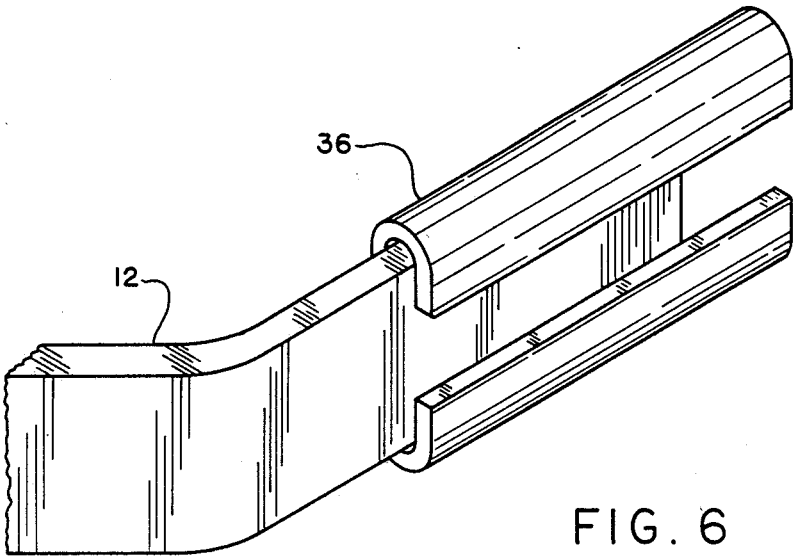
FIG. 6 is a partial isometric view of a support leg of the invention with an extension member mounted thereon.

FIG. 6 is a partial isometric view of a support leg 12 of the invention with an extension member 36 mounted thereon. As previously explained, the length of the support leg 12 will depend to a large degree on the size of the object to be supported. While larger objects can be accommodated by longer support legs, an alternative expedient is to provide the support legs with an extension member 36 which is adapted to fit around the support leg in a way in which it can be telescoped along the leg, in effect providing either a shorter or a longer leg as required. The extension member can be configured in a "C" shape, as shown, a vertically elongated "O" shape, or otherwise, as desired. The fabrication of the leg extension member from plastic is particularly desirable, since a snug fit can be achieved simply and inexpensively. The leg extensions can be provided for some or all of the legs as necessary or desirable.

Figure 6A:
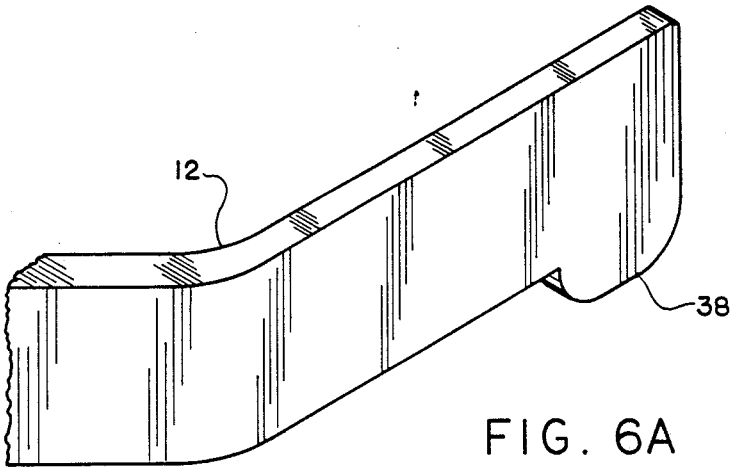
FIG. 6A is a partial isometric view of another embodiment of a support leg of the invention.

FIG. 6A is a partial isometric view of another embodiment of a support leg of the invention 12, employing projecting feet 38. The feet provide still further accommodation of the stand with uneven surfaces on which the support legs may sometimes rest.

While in accordance with the patent statutes, a preferred embodiment and best mode has been presented, the scope of the invention is not limited thereto but rather is measured by the scope of the attached claims.

What is claimed is:

1. A stand for holding a Christmas tree comprising components which include:

an elongate cannister;

a free-floating push plate;

push plate adjusting means, and two support legs, said push plate being disposed within said canister, and said support legs being attached to said canister, wherein said cannister has interconnected panels comprising: a rear wall, two parallel side walls, two converging walls, and a bottom in sealing relationship to the lower end of said walls, said walls defining a tube whose interior is adapted to receive the lower trunk of said tree, and wherein said push plate is not fastened to other components of said stand and is dimensioned to be received and moved within said tube, parallel to said side walls, and wherein further, said push plate adjusting means is mounted on said rear wall and adapted to adjust the position of said plate relative to the corner formed by the juncture of said converging walls, said adjusting means being operable to move said plate toward said corner to force said trunk into said juncture, and wherein still further, said support legs are adapted for being fastened adjacent to the lower end of said cannister so as to enable it to be supported in a generally vertical position.

2. A stand according the claim 1 in which said support legs are elongate members fastened to said cannister at an adjustable angle with respect to said cannister by adjustable connection means, permitting compensation for uneven surfaces and crooked tree trunks.

3. A stand according to claim 1 in which said connection means comprises an anchoring structure forming part of each of said side walls, connection between said cannister and said legs being achieved by a fastener connecting said structure and said legs.

4. A stand according to claim 3 wherein said anchoring structure comprises two vertical slotted tracks each of which is connected to one of said legs by one of said fasteners, and said fasteners are threaded fasteners with a head portion on one end thereof adapted to be retained in, but vertically moved in said tracks, and to have a nut threadably engaged on the other, threaded end thereof after the threaded end of said fastener is inserted through a slotted hole passing through said leg.

5. A stand according to claim 4 wherein at least one of said converging walls is provided with two spaced, vertical retaining grooves adapted to receive and retain a placard positioned therebetween.

6. A stand according to claim 1 wherein said walls and said free-floating push plate are planar.

7. A stand according to claim 1 wherein said push plate adjusting means comprises a crank having a threaded end, said threaded end engaging with and extending through said rear wall into the interior of said cannister.

8. A stand according to claim 7 wherein the threaded portion of said crank extends along an axis bisecting said corner.

9. A stand according to claim 1 wherein said tube is formed by being extruded from aluminum, and said bottom panel is also formed from aluminum, said tube and said bottom being joined by aluminum weldment, said weldment being covered with a water resistant coating.

10. A stand according to claim 1 wherein said support legs are elongate flange-like profiles whose ends are symmetrically bent away from the center of said legs.

11. A stand according to claim 10 wherein at least some of the ends of said support legs are provided with telescoping extensions.

12. A stand according to claim 10 wherein said legs are fabricated so that only the lower edge of said profiles at the ends of said legs is in contact with the surface on which the legs are supported.

13. A Christmas tree stand comprising:

an elongate cannister;

a free-floating push plate;

push plate adjusting means; and two support legs;

said push plate being disposed within said canister, and said support legs being attached to said canister, wherein said cannister has interconnected panels comprising a rear wall, two parallel side walls, two converging walls, and a bottom in sealing relationship with the lower end of said walls, said interconnected walls defining a tube having a generally pentagonal transverse cross-section, the interior of said tube being adapted to receive the lower trunk of said tree, and wherein said push plate is dimensioned to be received and moved within said tube, parallel to said side walls, and wherein further, said adjusting means comprises a crank having a threaded end, said threaded end extending in threaded engagement through said rear wall into the interior of said cannister, against said push plate, said crank being operable to move said plate against said trunk, thereby moving said trunk toward the corner formed by the conjuncture of said converging walls, and wherein still further, said support legs are elongate members connected to said cannister at an angle by anchoring structure so as to enable said cannister to be supported in a generally vertical position, the connection being adjustable so that the angle can be varied to conform the disposition of said legs to a surface on which said stand rests, and to compensate for crooked tree trunks, said anchoring structuring comprising two vertical slotted tracks located on the exterior of each of said side walls, the tracks on each of said side walls being connected to one of said legs by fasteners, one end of which is adapted to be retained by, and moved within said tracks, while the other end of said fasteners is adapted to be inserted through a hole passing through said leg and to be retainably secured in that position.

14. A stand according to claim 13 wherein at least one of said converging walls is provided with two spaced, vertical retaining grooves adapted to receive and retain a placard positioned therebetween.

* * * * *